US011318698B2

(12) United States Patent
Jonsson

(10) Patent No.: US 11,318,698 B2
(45) Date of Patent: May 3, 2022

(54) DUAL BOX SLOTTER

(71) Applicant: Berg Industries AB, Stockholm (SE)

(72) Inventor: Anneli Jonsson, Örebro (SE)

(73) Assignee: EMBA HOLDING AKTIEBOLAG, Stockholm (SE)

( * ) Notice: Subject to any disclaimer, the term of this patent is extended or adjusted under 35 U.S.C. 154(b) by 0 days.

(21) Appl. No.: 16/340,777

(22) PCT Filed: Oct. 12, 2017

(86) PCT No.: PCT/SE2017/051005
§ 371 (c)(1),
(2) Date: Apr. 10, 2019

(87) PCT Pub. No.: WO2018/070928
PCT Pub. Date: Apr. 19, 2018

(65) Prior Publication Data

US 2020/0047444 A1 Feb. 13, 2020

(30) Foreign Application Priority Data

Oct. 12, 2016 (SE) ..... 1651335-0

(51) Int. Cl.
*B31B 50/22* (2017.01)
*B31B 50/04* (2017.01)
(Continued)

(52) U.S. Cl.
CPC ..... *B31B 50/22* (2017.08); *B31B 50/006* (2017.08); *B31B 50/042* (2017.08); *B31B 50/26* (2017.08);
(Continued)

(58) Field of Classification Search
CPC ..... B31B 50/22; B31B 50/042; B31B 2120/70; B31B 50/68; B31B 50/624;
(Continued)

(56) References Cited

U.S. PATENT DOCUMENTS 3,952,637 A * 4/1976 Lambert ..... B26D 3/12 493/30
3,958,051 A * 5/1976 Smith ..... B26D 9/00 428/42.3
4,330,019 A * 5/1982 Murphy ..... B23D 45/10 144/357
(Continued)

FOREIGN PATENT DOCUMENTS

EP 0752299 A1 1/1997
GB 1042985 A 9/1996
WO 2016/132576 A1 8/2016

OTHER PUBLICATIONS

International Search Report to corresponding PCT application PCT/SE2017/051005, dated Dec. 6, 2017, 4 pages.

*Primary Examiner* — Ghassem Alie
(74) *Attorney, Agent, or Firm* — Cooper Legal Group, LLC; Ronald M. Kachmarik

(57) ABSTRACT

Arrangement for cutting notches in box blanks fed along a feeding direction. A feeding portion feeds box blanks. At least a first-fourth cutting devices along the feeding direction. The first is arranged most upstream and the fourth is arranged most downstream. Each device includes: a first wheel rotating around a first axis transverse to the feeding direction, the first wheel being on a first side of the blanks; a second wheel rotating around a second axis extending transverse to the feeding direction parallel to the first axis, the second wheel being in the same plane as the first wheel on an opposite side of the blank; and a cutting element cutting notches. The cutting element extends from either the first or the second wheel towards the other. A control unit controls the operation of the first-fourth devices for different operation combinations.

9 Claims, 6 Drawing Sheets

(51) Int. Cl.

| | |
|---|---|
| ***B31B 50/00*** | (2017.01) |
| *B31B 120/30* | (2017.01) |
| *B31B 50/62* | (2017.01) |
| *B31B 110/35* | (2017.01) |
| *B31B 120/70* | (2017.01) |
| *B31B 50/26* | (2017.01) |
| *B31B 50/68* | (2017.01) |

(52) U.S. Cl.
CPC ..... *B31B 50/624* (2017.08); *B31B 50/68* (2017.08); *B31B 2110/35* (2017.08); *B31B 2120/302* (2017.08); *B31B 2120/70* (2017.08)

(58) Field of Classification Search
CPC ..... B31B 2110/35; B31B 50/006; B31B 50/26; B31B 2120/306; B31B 2100/0022; B26D 1/245; B26D 3/14; B26D 7/26; B26D 3/12; B26D 7/2642; B26D 5/005; B26D 7/2628
USPC ..... 83/332, 368, 369, 437, 677, 76.7, 76.8, 83/699, 58.1, 58.4, 58.5, 425.4, 498, 499, 83/678, 671, 522
See application file for complete search history.

(56) References Cited

U.S. PATENT DOCUMENTS

| | | | | |
|---|---|---|---|---|
| 4,649,782 | A * | 3/1987 | Cavagna | B26D 5/04 83/425.4 |
| 4,874,996 | A * | 10/1989 | Rosenthal | G05B 19/414 318/567 |
| 7,040,207 | B2 * | 5/2006 | Lindenblatt | B23D 45/10 144/379 |
| 10,800,061 | B2 * | 10/2020 | Yamamuro | B26D 1/405 |
| 2014/0121085 | A1 * | 5/2014 | Kwarta | B26D 9/00 483/10 |
| 2016/0121501 | A1 * | 5/2016 | Baggot | B26F 1/10 83/37 |
| 2018/0178478 | A1 * | 6/2018 | Kodama | B26D 3/06 |
| 2018/0370061 | A1 * | 12/2018 | Tokumo | B31B 50/18 |

* cited by examiner

DUAL BOX SLOTTER

TECHNICAL FIELD

The present invention relates to an arrangement for cutting notches in box blanks fed through a cutting machine along a feeding direction L, and a machine comprising said arrangement.

TECHNICAL BACKGROUND

Packages of different types and sizes made of corrugated cardboard, or corrugated paperboard, are used within many different areas to pack and protect different kinds of products.

The manufacturing of these packages is generally performed in different steps starting from a rectangular sheet of raw corrugated paperboard. In the first step the raw sheets of paper board are cut, or trimmed, such that a substantially flat rectangular paper boards with a predetermined shape is formed. The prepared sheet of paper board is often referred to as a box blank. The shape of the box blank is adapted to generate a package with the desired size and shape in the end of manufacturing process when the box blank is folded to form the desired box.

Each box blank is designed to form a rectangular box and consequently comprises four side sections, bottom sections and top sections that after folding forms the bottom and top of the box. The bottom and top sections are preferably separated by a wider notch to facilitate folding the different sections and avoid that adjacent sections interfere with each other. The box blank furthermore comprises a tongue, frequently referred to as a glue flap which, after the folding of the box blank has been completed, will bear against the inner or outer side of the neighboring side section such that these may be joined together by an adhesive joint, an adhesive tape or staples.

The notches are cut into the desired shape and length by a cutting device arranged within the manufacturing device. Each cutting device comprises a first and a second wheel arranged on opposite sides of the box blank such that the box blank is held in the correct position between the substantially flat peripheral surfaces of the wheels during cutting. Both wheels rotate at constant speed corresponding to the feeding speed of the box blanks around axes extending transverse to the feeding direction of box blanks.

The box blanks are fed at substantially constant speed through the manufacturing device such that different actions could be performed on the paper board/box blank in a predetermined order. Manufacturing devices used today are designed to be able to manufacture box blanks with sizes within a predetermined range. If smaller box blanks are manufactured, the distance/time between the box blanks are increased since the manufacturing devices are designed to work at substantially constant speed.

One recently disclosed device designed to be slightly more flexible is presented in WO2016132576A1. The disclosed device comprises three rotational axes transvers to the feeding direction through the device. Each axis is provided with slotting wheels (35, 36, 37) that are arranged to cut slots in the box blanks fed through the device. Each slotting wheel (35; 36; 37) comprises two slotting elements (112, 113; 115; 116; 118, 119) extending from the periphery of the wheel and in order to make it possible to adjust the length of the slots cut in the box blank parallel to the feeding direction, the position of at least one of the two segments around the periphery of the slotting wheel is adjusted.

However, adjustment of the position of the slotting elements is very complicated and requires a very complex installation, alternatively requires a considerably time if done manually.

Manufacturing devices used today are not very flexible since they are designed to operate at substantially constant speed even though small box blanks are manufactured and there is consequently a need for more flexible arrangements that reduces the problems described.

SUMMARY OF THE INVENTION

The present invention relates to an arrangement for cutting notches in box blanks fed through a cutting machine, and a machine comprising said arrangement, that to at least some extent reduce the problems defined above.

The arrangement for cutting notches in box blanks fed through a cutting machine along a feeding direction L comprises:

feeding means arranged to feed box blanks along the direction L;

at least a first, a second, a third and a fourth cutting device arranged along the feeding direction L, said first cutting device is arranged most upstream along the feeding direction and said fourth cutting device is arranged most downstream along the feeding direction L, each of said first, second, third and fourth cutting device comprising:

- a first wheel arranged to rotate around a first axis extending substantially transverse to the feeding direction L, said at least one first wheel is arranged on a first side of the box blanks;
- a second wheel arranged to rotate around a second axis extending substantially transverse to the direction L parallel to the first axis, said second wheel is arranged in the same plane as the corresponding first wheel on opposite side of the box blank as the first wheel;
- a cutting element for cutting notches in the box blanks, said cutting element extend from either the first or the second wheel towards the opposite wheel; and
- a control unit arranged to control the operation of the first, second, third and fourth cutting device, wherein the control unit is configured to activate and deactivate different combinations of the first, second, third and fourth cutting device to adjust the length of the notches along the direction L and/or adapt the arrangement to cut notches in box blanks of different sizes.

The arrangement according to the invention fulfills the objectives defined above since the configuration of the different cutting devices increases the flexibility of the arrangement considerably. The arrangement is able to cut notches within a length within a wider range, and furthermore the arrangement could be operated at different speed depending on the size of the box blanks. If smaller box blanks are manufactured the speed could be increased compared to the manufacturing speed for larger box blanks.

The claimed arrangement increases the flexibility during manufacturing considerably since the four cutting devices could be used either separately, or in pairs, such that the length of the length of the notches is easily adapted to the specific design of the box. The change in configuration could be done easily by only involving one of the cutting devices in the process, or by activating the pair of cutting devices such that the length of the notch could be up to doubled.

In one embodiment of the arrangement, the first and second wheel of each cutting device is powered by engines operated by the control unit. This embodiment makes it possible to control each of the cutting devices independently of the other in an efficient way.

In one embodiment of the arrangement, the cutting element is extending along a section of the first or second wheel such that the cutting is deactivated by arranging the wheel with the cutting element in a position where the cutting element is arranged facing away from the box blanks. This embodiment provides a simple and reliable deactivation of selected cutting devices since the cutting element is stationary arranged separated from the box blanks fed through the arrangement.

In a first configuration of the arrangement, said arrangement is arranged to cut notches with a length along the direction L smaller than a predetermined length of 20 cm, and in said first configuration the first cutting device is arranged to cut a notch in a leading edge of the box blank and the fourth cutting device is configured to cut a notch in a trailing edge of the box blank. In the first configuration, the second and third cutting devices are deactivated. This first configuration is favorable for larger box blanks with notches with a length below the predetermined length.

In a second configuration of the arrangement, said arrangement is arranged to cut notches with a length along the direction L exceeding the predetermined length, and in said second configuration the first and second cutting device are arranged to cut a notch in a leading edge of the box blank and the third and fourth cutting device are arranged to cut a notch in a trailing edge of the box blank. This configuration is favorable since the range of the notch length is almost doubled which increases the number of different types of box blanks that could be manufactured considerably.

In a third configuration of the arrangement, said first and second cutting devices are arranged to cut a notch in a leading edge of alternating box blanks fed through the arrangement, and the third and fourth cutting devices are configured to cut a notch in a trailing edge of alternating box blanks fed through the arrangement. This configuration enables a higher manufacturing speed.

The control unit is arranged to operate the arrangement according to the selected configuration to adapt the arrangement to the size and dimensions of the manufactured box blank.

In one embodiment of the arrangement, the control unit is arranged to control the feeding means to adapt the feeding speed of box blanks. This embodiment is favorable since it increases the accuracy of the cut notch. As discussed further down in the detailed description, the feeding means has structures that are not for cutting the notch.

The invention furthermore relates to a machine for cutting paper board sheets to form box blanks, said machine comprising:

a feeding arrangement arranged to feed paper board sheets along a direction L; and at least one arrangement for cutting notches in box blanks according to claim 1.

One embodiment of the machine further comprises one, or more, additional arrangements according to claim 1 to cut notches substantially parallel to the feeding direction L separated from each other. This embodiment is favorable since further notches could be cut simultaneously which reduces the time to complete the process as well as the overall size of the machine.

The different embodiments described above could of course be combined in different ways without departing from the scope of the invention.

BRIEF DESCRIPTION OF THE DRAWINGS

The above as well as further objectives and advantages with the present invention will become apparent when studying the following illustrative and non-limiting detailed disclosure of preferred embodiments of the present invention, with reference to the appended drawings.

All figures are schematic, not necessarily to scale, and generally only illustrating selected parts which are necessary in order to elucidate the invention, wherein other parts may be omitted or merely suggested.

DETAILED DESCRIPTION

The present invention, as previously stated, relates to an arrangement for cutting notches in board sheets to form box blanks. The arrangement is furthermore adapted to be arranged in a machine for cutting paper board sheets to form box blanks. In the figures, box blanks, selected parts of the arrangement according to the invention and the machine are illustrated in order to elucidate the essential features of the invention.

Manufacturing of boxes of corrugated paperboard is performed in two main steps. The first step involves the production of corrugated paperboard from rolls of paper, commonly three rolls, while the second step involves cutting, or trimming, of the paperboard to form box blanks 100 which after folding and gluing form a box with the desired shape and dimensions.

Figure 1:
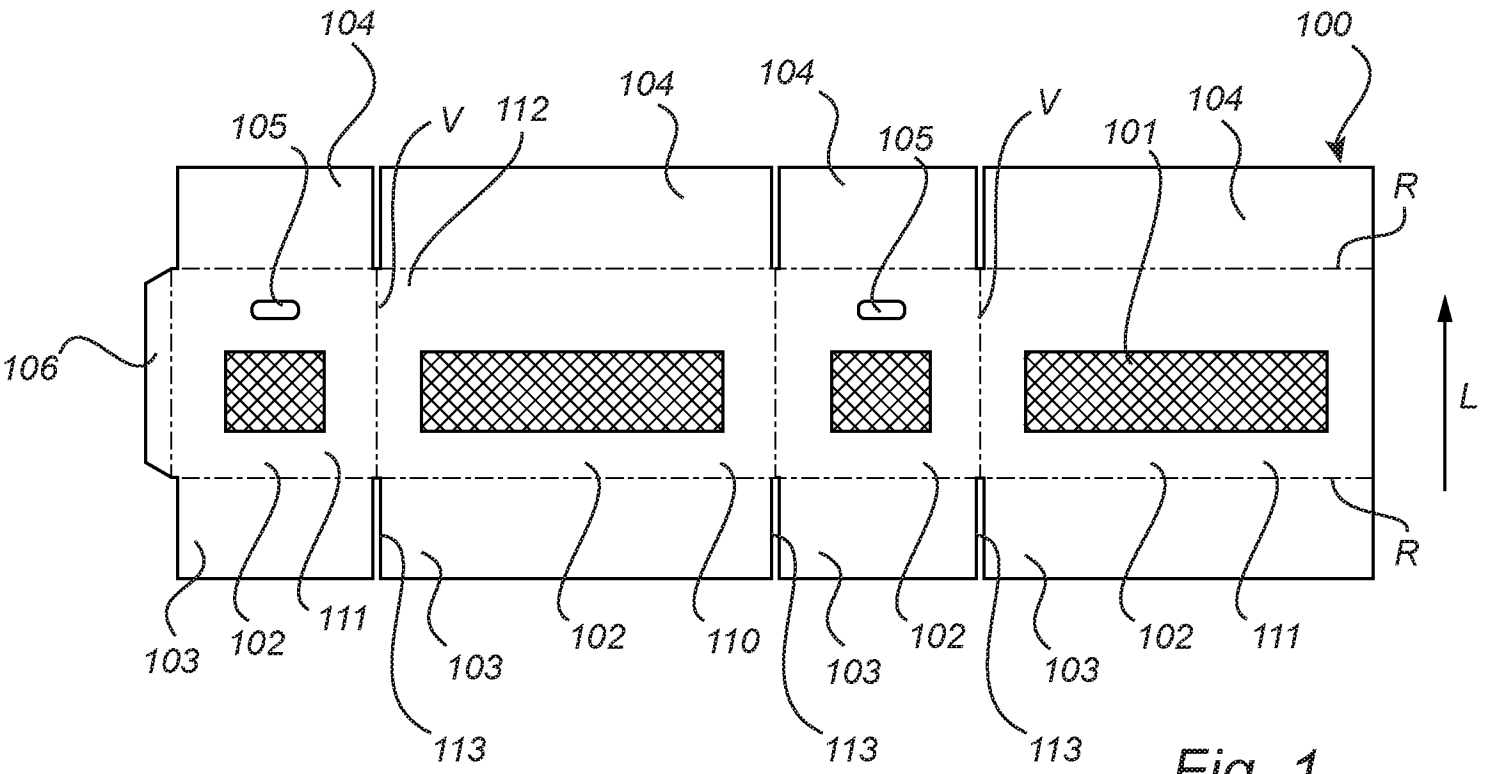
FIG. 1 illustrates an example of a paper board sheet cut to form a box blank.

To facilitate the folding of the top and bottom of the box creasing lines V, also referred to as "scoring lines", are formed in the box blank. One conceivable variant of these creasing lines is illustrated in FIG. 1. The positions of the creasing lines are adapted to the desired size and shape of the box. Equipment to obtain these creasing lines is not illustrated or described in this application since the equipment is well known in the art and not related to the invention this application aims to protect.

In FIG. 1 an example of a box blank 100 cut into a shape which after folding yields in a rectangular box of ordinary type is illustrated. On the box blank 100, any contemplated décor 101 or text may be printed before folding since it is normally easier to print with the desired result before the box blank has passed the folding machine and obtained its final shape.

The box blank 100 illustrated forms a rectangular box and therefore comprises four side section 102 forming the side walls of the box, four bottom sections 103 forming the bottom of the box and four top sections 104 which may be utilized for closing the box. Between the different top sections as well as the bottom sections notches 113 are cut in the box blank to facilitate folding the box blank into the intended shape. The notches 113 prevent that adjacent bottom and top sections get stuck to each other. Furthermore, two handles 105 have been cut out in opposite side sections.

The box blank furthermore comprises a tongue 106, frequently also referred to as "glue flap", for adhesive or staples. After the folding, the glue flap will bear against the inner or outer side of the neighboring side section such that these are secured together by the adhesive or staples to form the box.

Figure 2:
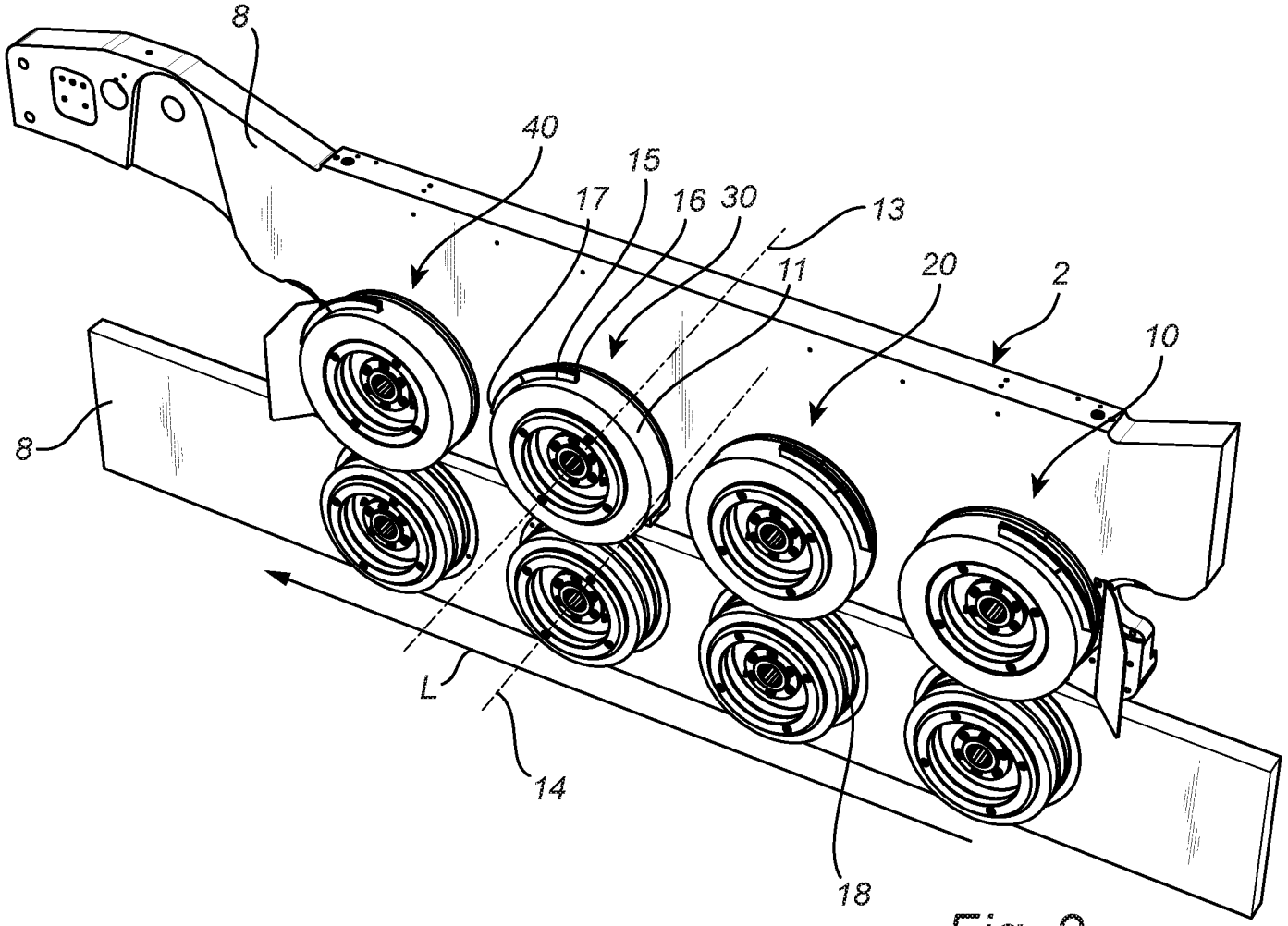
FIG. 2 illustrates a perspective view of the arrangement according to the invention schematically.

The arrangement 2 according to the invention is illustrated schematically in FIG. 2. The arrangement is intended for cutting the notches 113 illustrated in the paper board sheet in FIG. 1.

The paper board sheets are fed through the arrangement 2 along a longitudinal feeding direction L by a feeding arrangement not illustrated in FIG. 2 but described further down in the detailed description. Specifically, see FIG. 4 and the associated description.

The arrangement 2 according to the invention comprises a first 10, a second 20, a third 30 and a fourth 40 cutting device arranged along the feeding direction L. The first cutting device 10 is arranged most upstream along the feeding direction L and the fourth cutting device 40 most downstream the feeding direction L. The first, second, third and fourth cutting devices, as well as thereto related different components, are supported by a support frame 8 to ensure a rigid and stable support of the arrangement. In FIG. 2 only selected parts of the support frame are illustrated.

Each cutting device comprises a first wheel 11 and a second wheel 12 that both are rotatably arranged around a corresponding first 13 and second axis 14. The first 13 and second 14 axes are substantially parallel and extend in this embodiment of the arrangement in substantially horizontal direction transverse to the feeding direction L of box blanks.

The first and second wheel of the different cutting devices is arranged in the same plane transverse to the first and second axis of each cutting device. In each cutting device the outer periphery of the first and second wheel are arranged adjacent to each other and arranged such that the paper board sheets are passing between the outer periphery of the first and second wheel.

The first and second wheel of the first, second, third and fourth cutting devices are all arranged substantially in the same plane and powered independently of each other by engines such that the different cutting devices could be activated and stopped independently of the other by a control unit 4 arranged to monitor and operate the arrangement according to the selected configuration. The outer peripheral surfaces of the first and second wheel are substantially flat and parallel to the first and second axis to provide support for the box blanks fed between the wheels.

The first wheel 11, in the illustrated embodiment arranged above the second wheel 12 and the box blanks, comprises a cutting element 15. The cutting element 15 extends from the peripheral surface of the first wheel in substantially radial direction from the first axis and is when the cutting element is facing the second wheel extending towards the peripheral surface of the opposite second wheel. The cutting element has a shape along the peripheral surface of the wheel corresponding to the desired shape of the notch. The cutting element 15 extends along a section of the peripheral surface of the first wheel 11 and has a leading edge 16 and a trailing edge 17.

The peripheral surface of the second wheel is preferably made of an elastic material such as a plastic or rubber material in order to reduce wear on the cutting edge and increase the time between required replacements of the cutting element. The material in the peripheral surface is for example polyurethane rubber.

The distance between the peripheral surface of the second wheel 12 and the cutting edge of the cutting element is adjustable in order to make it possible to the calibrate the distance between the cutting edge and the surface of the second wheel such that the cutting edge is only precisely touching the surface of the second wheel. The cutting edge must touch the surface of the second wheel to ensure that the cutting edge is cutting all the way through the box blank.

The cutting element extend along a section of the periphery of the first wheel in order to make it possible to deactivate the cutting by arranging the wheel with the cutting element in a position where the cutting element is not interfering with the box blanks fed through the arrangement.

The cutting element 15 is either formed in one piece or by at least two or more cutting segments arranged adjacent to each other along the peripheral surface of the first wheel to make is possible to replace only selected cutting segments.

In an alternative embodiment, the cutting element extend in radial direction from the first wheel into a corresponding recess 18 in the second wheel forming a male/female configuration of the cutting element and the recess such that the box blank is cut between the cutting element and the edges along each side of the recess. This embodiment is illustrated in the cutting devices in FIG. 2. The cutting element extends into the recess but not all the way to the bottom of the recess to prevent damages on the cutting element.

Furthermore, the position of the first and second wheel in relation to the box blanks could be switched without changing the general idée of the invention.

The arrangement furthermore comprises feeding means 50 (see FIG. 4) arranged to feed box blanks along the feeding direction L. With the feeding means 50 so arranged, the feeding means 50 may also be referred to herein as a feeding arrangement 50. The feeding means 50 comprises two longitudinal beams which extend in parallel direction to the feeding direction L. The beams are not the first cutting device 10, the second cutting device 20, the third cutting device 30 or the fourth cutting device 40. It is to be recalled, in distinction, that each respective cutting device 10-40 includes a respective pair of first and second wheels and the beams are not the respective pair of first and second wheels. Focusing again upon the feeding means, the distance between the beams may be varied in order to adapt the arrangement to box blanks of different sizes. The beams are straight and extend along the total length of the feeding arrangement 50. The beams comprise rectangular cross sections wherein two of the sides are substantially horizontal and two vertical. Feeding belts 52 run along the lower sides of the beams and are moved at the desired feeding speed such that the box blanks are transported at the desired speed along the lower side of the beams. With the feeding belts 52 running along the beams and the beams extend in a parallel direction to the feeding direction L, the feeding belts 52 have a similar extent parallel to the feeding direction L (see FIG. 4). The belts 50 are not the first cutting device 10, the second cutting device 20, the third cutting device 30 or the fourth cutting device 40. It is to be recalled, in distinction, that each respective cutting device 10-40 includes a respective pair of first and second wheels and the belts 52 are not the respective pair of first and second wheels. It is to be noted within the example shown in FIG. 4, the feeding belts extend past all of the first cutting device 10, the second cutting device 20, the third cutting device 30 and the fourth cutting device 40, with the extent being parallel to the feeding direction L. Focusing again upon the feeding means, the belts 52 are endless and run around a drive wheel and a number of return wheels, generically indicated by reference numeral 54, arranged in the respective ends of the feeding arrangement 50 and at selected positions along the belts. The drive and return wheels 54, which are located at the ends, are not the first cutting device 10, the second cutting device 20, the third cutting device 30 or the fourth cutting device 40. It is to be recalled, in distinction, that each respective cutting device 10-40 includes a respective pair of first and second wheels and the drive and return wheels 54, which are located at the ends, are not the respective pair of first and second wheels. Focusing again upon the feeding means, the box blanks are held in place against the feeding belt and the lower side of the beam by means of a negative pressure in the beam and openings in the feeding belt and the lower side of the beams, such that the box blank is sucked to the belt and the beam and thereby held in place during the movement through the arrangement. The negative pressure is generated by a pump arrangement that reduces the pressure in the beam. The feeding arrangement 50 may be modified in many different ways, such as for example by allowing the box blanks to be moved along the top side of the beams, by changing the design of the feeding belts or the pump arrangement within the scope of the invention. As mentioned above, the control unit is arranged to control the feeding means/feeding arrangement 50 to adapt the feeding speed of box blanks. Such is favorable since it increases the accuracy of the cut notch.

Figure 3A:
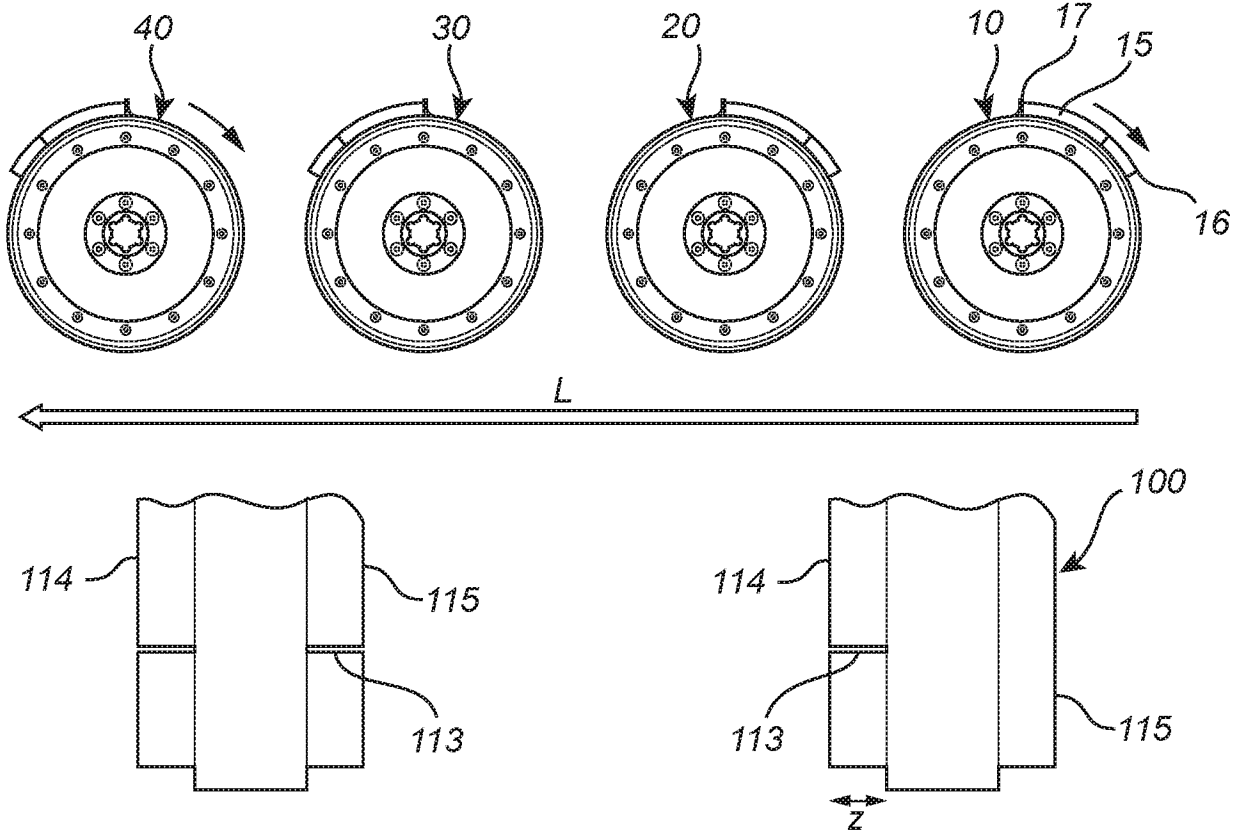
FIGS. 3*a*, 3*b* and 3*c* illustrates schematically selected parts of the arrangement and a box blank fed through the arrangement in the different configurations.
Figure 3B:
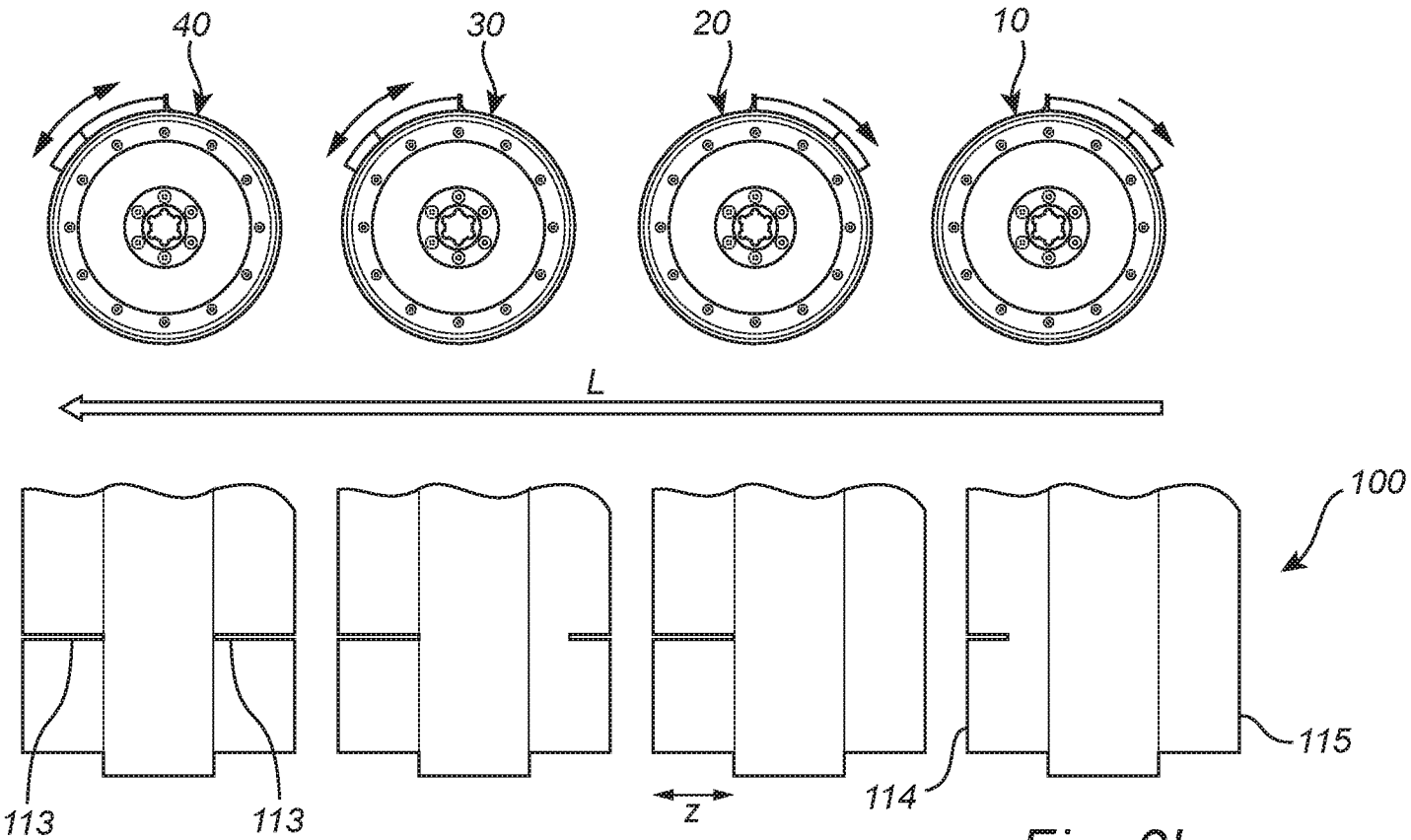

The arrangement furthermore comprises a control unit 4 arranged to control the operation of the first, second, third and fourth cutting device according to the selected configuration. The different configurations are illustrated in FIG. 3*a*-3*b*.

The control unit 4 is arranged to control and operate the different cutting devices independently of each other to activate and deactivate different combinations of the first, second, third and fourth cutting device to adjust the length of the notches along the direction L and/or adapt the arrangement to cut notches in box blanks of different sizes at different speeds.

Figure 3C:
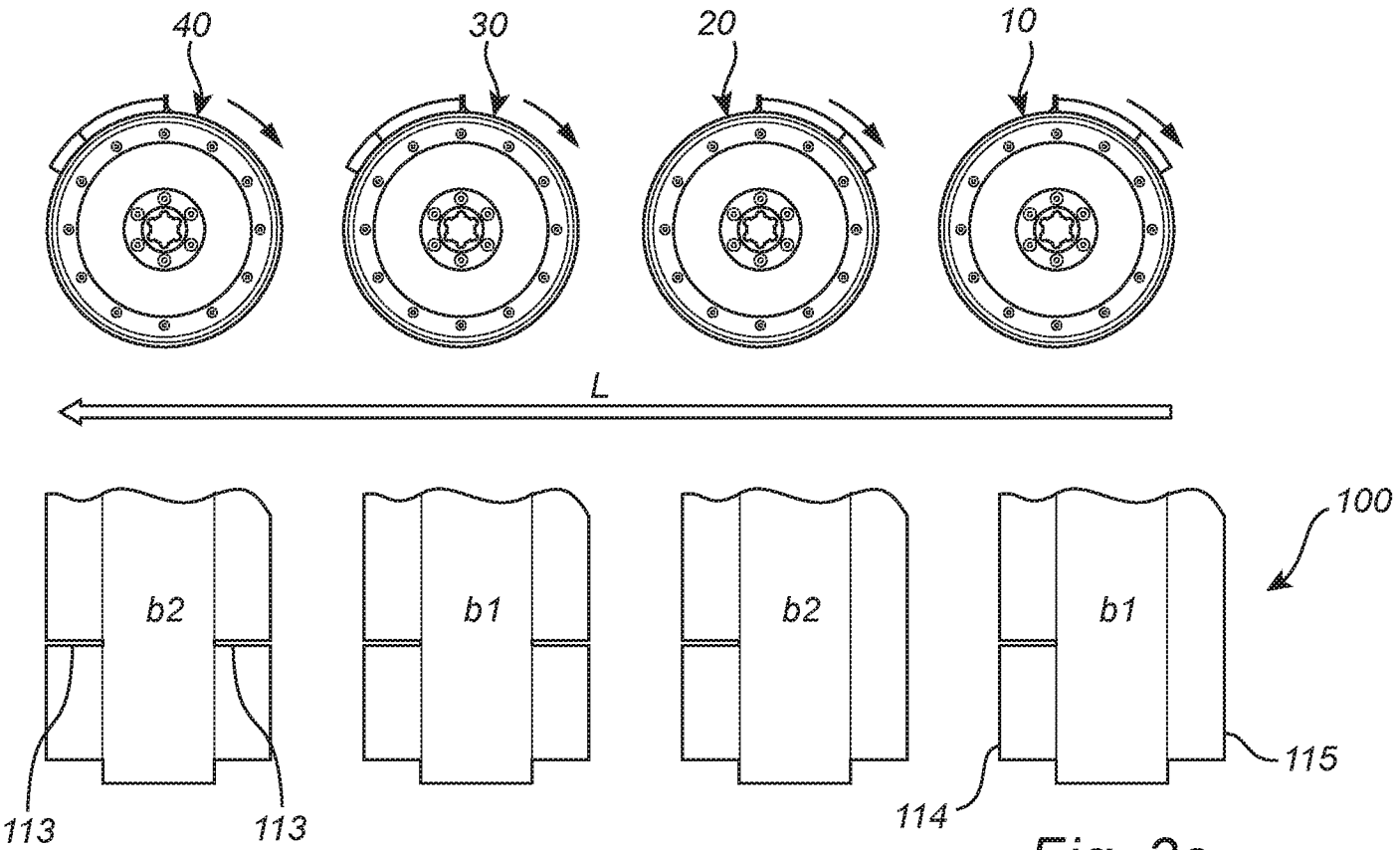

The control unit is configured to operate the arrangement in the three different configurations depending on the type and design of box blanks manufactured, as well as the desired manufacturing speed. The first configuration is schematically illustrated in FIG. 3*a*, the second configuration is schematically illustrated in FIG. 3*b* and the third configuration schematically illustrated in FIG. 3*c*.

During the set up of the machine comprising the arrangement according to the invention information regarding the desired size and shape of the manufactured box blank is provided to the control unit via a not illustrated user interface. The control unit processes the information and the feeding means 50 are operated to feed paper board sheets in the desired shape through the machine and the control unit configures the arrangement according to the invention to cut the desired notches by selecting the suitable configuration of the arrangement.

The control unit is arranged to operate and control each cutting device independently of each other. The control unit furthermore receives information of the position of each box blank fed through the arrangement either from sensors arranged at predetermined positions along the arrangement or by information provided from the feeding means 50 to be able to activate or deactivate the different cutting devices to form box blanks with the desired notches. As discussed above, the feeding means 50 advantageously has structures that are not for cutting the notch.

In the first configuration, said arrangement is arranged to cut notches with a length z along the direction L smaller than a predetermined length of approximately 20 cm. In said first configuration, the first cutting 10 device is rotated to cut a notch 113 in a leading edge 114 of the box blank 100 and the fourth cutting device 40 arranged to cut a notch 113 in a trailing edge 115 of the box blank. In the first configuration, the second and third cutting devices are deactivated by arranging the cutting elements in a position separate from the box blanks fed through the arrangement. The cutting element of each cutting device has a length along the peripheral surface of the first wheel corresponding to the predetermined length z such that in the first configuration one cutting element is able to cut the desired notch 13.

In the second configuration, said arrangement is arranged to cut notches 113 with a length z along the direction L exceeding the predetermined length. To increase the length of the notch 113 that is cut, the first 10 and second 20 cutting device are arranged to each cut a part of the notch 113 in the leading edge 114 of the box blank 100 thereby increasing the overall length of the notch 113. The third 30 and fourth 40 cutting devices are used in combination to cut a notch 113 in a trailing edge 115 of the box blank. This configuration is favorable since the range of the notch length is almost doubled which increases the number of different types of box blanks, i.e. boxes of different design and size that could be manufactured by a machine comprising the arrangement according to the invention considerably.

In the third configuration of the arrangement, the first 10 and second 20 cutting devices are arranged to cut a notch 113 in a leading edge of alternating box blanks fed through the arrangement. The alternating box blanks are marked with b1 and b2 in FIG. 3*c*. The third 30 and fourth 40 cutting devices are configured to cut a notch 113 in a trailing edge of alternating box blanks fed through the arrangement to enable a higher feeding speed through the arrangement. In the third configuration the first and third cutting device are configured to cut notches in the same box blank b1 while the second and fourth cutting device are arranged to cut notches in the same box blanks b2. Consequently, the arrangement according to the third configuration is only able to cut notches with a length up to the predetermined length z, i.e. approximately 20 cm.

The control unit is configured to operate the different cutting devices such that the cutting element of each cutting device is arranged in the position adjacent to the peripheral surface of the second wheel at the same time as the box blank enters the space between the first and second wheel of the cutting device such that a notch with the desired length is cut in the box blank.

The first and second cutting devices are arranged to cut notches in the leading edge of the box blanks, i.e. the cutting elements cut into the leading edge of the box blank to the trailing edge of the cutting element ends the cutting before the first wheel is rotated further and the cutting element removed from the box blank to end the cutting.

The third and fourth cutting device work in a similar but opposite way since they are arranged to cut notches in the trailing edge 115 of the box blanks, i.e. the leading edge of the cutting elements form the inner end of the notch before further rotation of the first wheel extends the cut towards the trailing edge 115 of the box blank.

In order to achieve the desired result the control unit must operate and control each cutting device, i.e. the rotation of the wheel comprising the cutting element, with high accuracy to ensure that the cutting in the leading and trailing edge of the box blank is initiated and ended at the intended position in the box blank.

Figure 4:
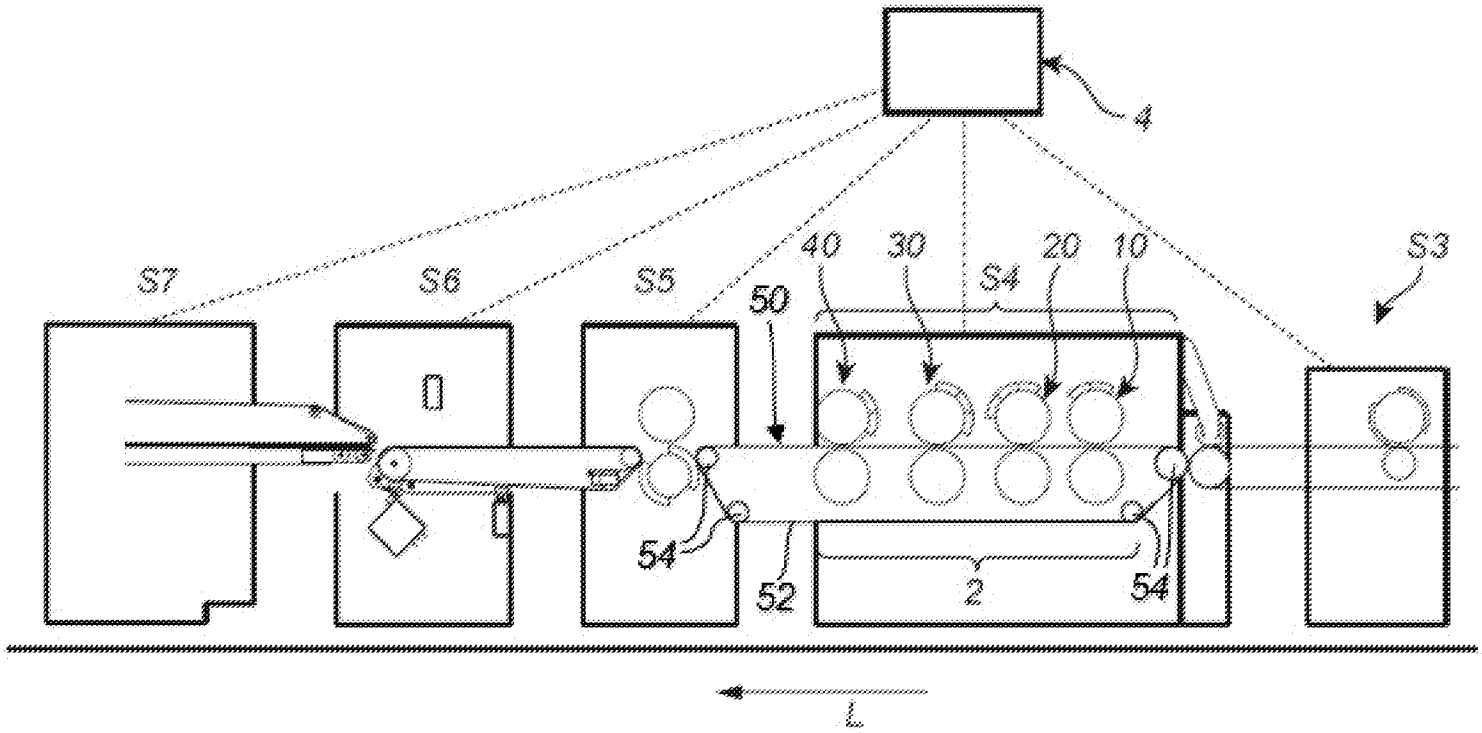
FIG. 4 illustrates a schematic presentation of selected parts of a machine for making paper boxes.

The arrangement according to the invention is arranged in a machine for manufacturing paper board boxes. The cutting of manufactured paper board into the desires shape is one step among several different steps that has to be completed to manufacture different types of boxes. Mostly, the machines comprises several different arrangements arranged along the feeding direction L to perform different manufacturing steps such as for example cutting the paper board sheet into the desired shape and applying a decorative ornament or text on the box blank. Selected parts of an embodiment of a machine are schematically illustrated in FIG. 4 where examples of different steps performed in the machine are illustrated.

The first step in the machine involves the manufacturing of paper board from different rollers of paper, not illustrated. In the second step the paper board is cut to the desired size and shape to form box blanks, not illustrated. A third optional step S3 could involve printing a decoration on the box blanks before the arrangement according to the invention cut notches in the box blank in step S4. In step S5 handles or other openings are cut in the box blank and in step S6 different pieces of material cut from the box blank are removed to prevent damages or problems during the remaining step S7 where the box blanks are folded.

In order to perform the different steps the machine comprises several different arrangements and units arranged to perform the different manufacturing steps. Folding machines of this type have a considerable size and weight and the different arrangements and units described are all supported by a not fully illustrated support frame 8 which is placed on substantially planar and stable ground.

The machine comprises a longitudinal axis which extends through the centre of the machine parallel to the feeding direction L of the box blanks through the machine. The schematically illustrated machine comprises, on either side of the longitudinal axis, substantially the same equipment arranged to perform analogous actions on the opposite sides of the box blank being moved through the machine.

The machine comprises at least one arrangement according to the invention for cutting notches in box blanks. The arrangement according to the invention is configured for cutting notches along the same direction parallel to the feeding direction L but in most box blanks further notches are cut along different directions parallel to the feeding direction so further corresponding arrangement according to the present invention could be arranged in the machine, preferably arranged on the same axes transverse to the feeding direction L to make it possible to simultaneously cut further notches in the box blank. Preferably the position of the different cutting devices transverse axes could be adjusted to be able to adapt the machine for cutting box blanks of different design and size.

The machine furthermore comprises a plurality of different components and arrangements each controlled and operated by the control unit. The control unit further comprises an interface for controlling/programming of the machine for setting the desired type of box, size etc.

In order to clearly illustrate the functionality of the arrangement according to the invention, the illustrations are simplified and need not be to scale, for example some measurements may be exaggerated in order to illustrate some features.

In the appended drawings different embodiments of the arrangement and machine according to the claims are illustrated. A plurality of the component of the arrangement and the machine may however be modified in a plurality of ways without departing from the scope of the invention as defined by the appended claims.

The invention claimed is:

1. An arrangement for cutting notches in box blanks fed through a cutting machine along a feeding direction, said arrangement comprising:

feeding means arranged to feed box blanks along the feeding direction, the feeding means comprising at least one feeding belt having an extent parallel to the feeding direction with the box blanks held against the feeding belt during movement in the feeding direction;

at least a first, a second, a third and a fourth cutting devices arranged along the feeding direction and being separate structure from the feeding belt of the feeding means, said first cutting device is arranged most upstream along the feeding direction and said fourth cutting device is arranged most downstream along the feeding direction, each of said first, second, third and fourth cutting device comprising:

a first wheel arranged to rotate around a first axis extending substantially transverse to the feeding direction and being separate structure from the feeding belt of the feeding means, said at least one first wheel is arranged on a first side of the box blanks;

a second wheel arranged to rotate around a second axis extending substantially transverse to the feeding direction parallel to the first axis and being separate structure from the feeding belt of the feeding means, said second wheel is arranged in the same plane as the corresponding first wheel on opposite side of the box blank as the first wheel; and a cutting element for cutting notches in the box blanks, said cutting element extends from either the first or the second wheel towards the opposite wheel, the cutting element being fixed upon a periphery of the respective first or the second wheel and of fixed peripheral length about the respective first or the second wheel;

wherein each of said first, second, third and fourth cutting devices is separately selectively activable to perform a notch cutting action or deactivatable to abstain from a notch cutting action, and a control unit arranged to control the operation of the first, second, third and fourth cutting devices, wherein the control unit is arranged to activate and deactivate different combinations of the first, second, third and fourth cutting device to operate the arrangement at different configurations to adjust the length of the notches along the feeding direction and/or adapt the arrangement to cut notches in box blanks of different sizes.

2. The arrangement according to claim 1, wherein the first and second wheel of each cutting device are powered by engines operated by the control unit.

3. The arrangement according to claim 1, wherein the cutting element is extending along a section of the first or second wheel such that the cutting is deactivated by arranging the wheel with the cutting element in a position where the cutting element is arranged facing away from the box blanks.

4. The arrangement according to claim 1, wherein said arrangement in a first configuration is arranged to cut notches with a length along the feeding direction smaller than a predetermined length of 20 cm, and in said first configuration the first cutting device is arranged to cut a notch in a leading edge of the box blank and the fourth cutting device is configured to cut a notch in a trailing edge of the box blank.

5. The arrangement according to claim 4, wherein said arrangement in a second configuration is arranged to cut notches with a length along the feeding direction exceeding the predetermined length, and in that in said second configuration the first and second cutting device are arranged to cut a notch in the leading edge of the box blank and the third and fourth cutting device are arranged to cut a notch in the trailing edge of the box blank.

6. The arrangement according to claim 5, wherein said arrangement in a third configuration the first and second cutting device are arranged to cut a notch in the leading edge of alternating box blank fed through the arrangement, and the third and fourth cutting device are configured to cut a notch in the trailing edge of alternating box blanks fed through the arrangement.

7. The arrangement according to claim 1, wherein the control unit is arranged to control the feeding means to adapt the feeding speed of box blanks.

8. A machine for cutting paper board sheets to form box blanks, said machine comprising:

a feeding arrangement arranged to feed paper board sheets along a feeding direction; and at least one arrangement for cutting notches in box blanks according to claim 1.

9. The machine according to claim 8, further comprising one, or more, additional arrangements according to claim 1 to cut notches substantially parallel to the feeding direction separated from each other.

* * * * *